US005730555A

United States Patent [19]

Stoner

[11] Patent Number: 5,730,555

[45] Date of Patent: Mar. 24, 1998

[54] GROUND ANCHOR

[76] Inventor: Ronald Stoner, Stoner Steel Products Company, 3009 Colonial Dr., Charlottesville, Va. 22901

[21] Appl. No.: 678,109

[22] Filed: Jul. 11, 1996

[51] Int. Cl.[6] ..... E02D 5/80; E04H 17/22

[52] U.S. Cl. ..... 405/244; 405/253; 405/259.1; 52/153; 52/154

[58] Field of Search ..... 405/259.1, 244, 405/258, 253, 231; 52/153, 154

[56] References Cited

U.S. PATENT DOCUMENTS

| | | | |
|---|---|---|---|
| 113,872 | 4/1871 | Gill . | |
| 380,627 | 4/1888 | Harmon et al. . | |
| 2,910,149 | 10/1959 | Lionberger | 52/153 |
| 3,132,726 | 5/1964 | Johnson . | |
| 3,286,416 | 11/1966 | Ashworth | 52/153 |
| 3,775,924 | 12/1973 | McClure, Jr. | 52/153 X |
| 3,896,596 | 7/1975 | Berger . | |
| 4,140,427 | 2/1979 | Jackson | 52/153 X |
| 4,553,358 | 11/1985 | Deike | 52/153 X |
| 5,104,265 | 4/1992 | Halloran, Jr. | 405/253 X |

FOREIGN PATENT DOCUMENTS 532913 9/1955 Italy .

*Primary Examiner*—Tamara L. Graysay
*Assistant Examiner*—Frederick Lagman
*Attorney, Agent, or Firm*—Richard C. Litman

[57] ABSTRACT

A ground anchoring system that prevents lateral movement of an anchoring post. The system is characterized by an anchor plate removably mounted upon a cylindrical anchoring post. Opposing channels are formed on the post and extend along the longitudinal axis of the post to a stop located within each of the respective channels. The anchor plate includes first, a second, and a third portion. The first and third portions project from the plate in a direction opposite to the second portion to form two generally diamond shaped apertures in the anchor plate when viewed along its longitudinal axis. The diamond shaped apertures are sized to allow the post to pass through when the longitudinal axis of the post is in line with the longitudinal axis of the plate. The second and third portions of the plate include tabs to fit within the channels and engage the stops of the post. In an alternative embodiment of the system, the anchor plate is formed with a pair of flanges at the side edges which project from the plate in opposing directions.

6 Claims, 3 Drawing Sheets

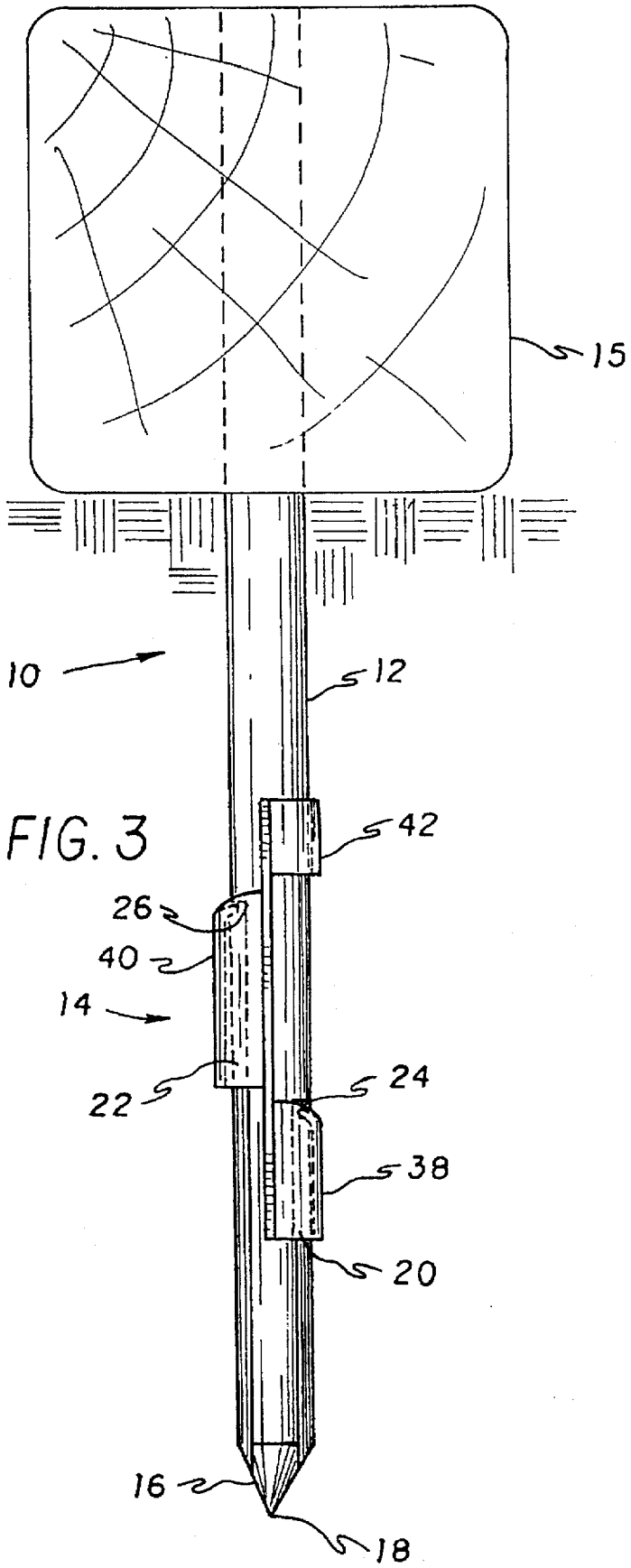
FIG. 3
FIG. 4
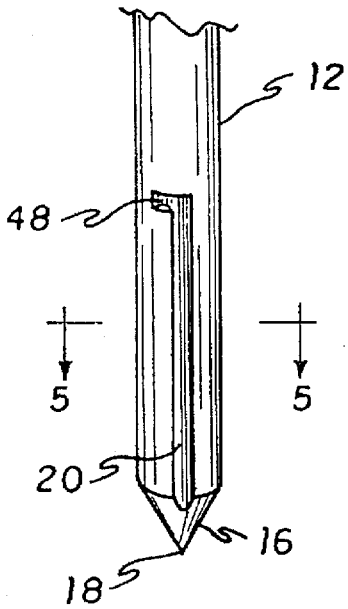
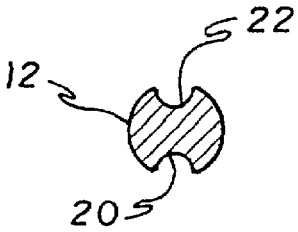
FIG. 5

GROUND ANCHOR

BACKGROUND OF THE INVENTION

1. Field of the Invention

The present invention relates to anchoring posts and anchors placed in the ground to minimize movement of the post in predetermined directions. The invention relates specifically to an anchoring system having an anchor plate removably mounted to an anchoring post.

2. Description of the Prior Art

Posts of metal and wooden construction often require external stabilizing to effectively resist lateral forces applied to the upper portion of the post and to maintain the post in substantially the same relationship to the ground. The shifting of the earth or ground under alternate conditions of thawing and freezing, under extreme wetting, or unbalanced loads applied to the post, can all impart lateral forces on the post, causing the post to move from its preset position.

One procedure in setting the post in a desired position is to dig an enlarged hole, fill the hole with concrete or other anchoring material, set the post in this material, and maintain it in the desired position until the anchoring material has hardened. However, the labor required to dig such enlarged holes and place the concrete or anchoring material, as well as the cost of the concrete itself, represent a substantial investment in both time and money.

Additionally, it has been routine practice to attach a plate-like structure to the post and subsequently drive the post into the ground to maintain the post in an upright position. The plate may be initially attached to the post or it may be assembled therewith and driven into the ground as a second step. Such plates must tightly fit around the post in order to accomplish their purpose, otherwise the post may move within the confines of the holding part of the plate. As a result, removal of the post from the ground is often very difficult because the anchor plate may also need to be removed. No anchoring system is seen in the prior art which allows the anchoring post to be securely fastened to the anchor plate yet allowing the post to be easily removed from the ground.

U.S. Pat. No. 3,896,596, issued to Beger, shows an anchor plate for a fence post comprising a sheet metal plate and a U-shaped bracket which cooperatively engage to mechanically couple with a fence post. The plate is formed with an aperture into which the U-shaped bracket is positioned to form an open ended socket. The plate and bracket, when assembled, cooperatively engage a post previously positioned in the ground through the open ended socket.

U.S. Pat. No. 3,312,726, issued to Johnson, illustrates a post anchor plate formed from a unitary piece of sheet metal having a central strap portion formed to engage the post. The anchor plate includes a curved lower end adapted to cause the plate to move away from the axis of the post as the post is driven, promoting frictional contact between the post and the plate which results in a tight fit therebetween in the final installation. The Beger and Johnson patents do not teach or suggest a ground anchor system having a post with opposing channels to engage a removable anchor plate.

U.S. Pat. No. 380,627, issued to Harmon and Nutt, shows a V-shaped fence post having one or more anchors removably secured to the front edge of the post. An opening is cut into the front edge of the post to receive the tongue of the anchor. A wedge is inserted between the tongue and the rear side of the post to secure the anchor to the post.

U.S. Pat. No. 113,872, issued to Gill, illustrates a fence post having a flanged anchor provided with a central tubular neck which is loosely fitted over the post.

Italian Patent No. 532,913, issued to Siebwaren, shows a fence post having a triangular shaped anchor plate attached thereto. None of the above referenced patents teach or suggest a ground anchoring system having a post with opposing channels to engage a removable anchor plate.

None of the above inventions and patents, taken either singly or in combination, is seen to describe the instant invention as claimed.

SUMMARY OF THE INVENTION

Accordingly, it is a principal object of the invention to provide an improved anchoring system for use in numerous applications including, landscaping, gardening, and fencing.

It is another object of the invention to provide an improved anchoring system including an anchoring post and a removable anchor plate.

It is a further object of the invention to provide an improved anchoring system including an anchoring post and a removable anchor plate that allows for easy installation and provides increased lateral support for all applications.

Still another object of the invention is to provide an improved anchoring system which allows an anchoring post to be securely fastened to the anchor plate yet allows the post to be easily removed from the ground.

It is an object of the invention to provide improved elements and arrangements thereof in an apparatus for the purposes described which is inexpensive, dependable and fully effective in accomplishing its intended purposes.

In accordance with the objects of the invention, there is provided a ground anchoring system for preventing the lateral movement of an anchoring post. The system includes an anchor plate removably mounted upon a anchoring post having a tapered end. A first and second channels are formed on the post and extend from the tapered end of the post and terminate at a stop located within each of the respective channels. The anchor plate includes a first, a second, and a third portion. The first and third portions project from the plane of the plate in a first direction and the second portion projects from the plane of the plate in a second direction opposite to the first direction whereby the first, second, and third portions form two generally diamond shaped apertures in registry with one another. The diamond shaped apertures are sized to allow the post to pass through when the longitudinal axis of the post is in line with the longitudinal axis of the plate. The first and second portions of the plate include tabs extending therefrom in opposing directions so as to fit within the channels and engage the stops of the post. In an alternative embodiment of the system, the anchor plate is formed with a pair of flanges projecting out of the plane of the plate in opposing directions. The flanges extend from the side edges of the plate to provide additional lateral support to the anchoring post.

These and other objects of the present invention will become readily apparent upon further review of the following specification and drawings.

BRIEF DESCRIPTION OF THE DRAWINGS

FIG. 3 is a side elevational view of the invention showing the anchoring post attached to the anchor plate and driven into the ground to support a landscaping timber.

FIG. 4 is a side elevational view of the anchoring post showing a channel formed in the anchoring post.

FIG. 5 is a cross-sectional view of the anchoring post taken along line 5—5 of FIG. 4.

Similar reference characters denote corresponding features consistently throughout the attached drawings.

DETAILED DESCRIPTION OF THE PREFERRED EMBODIMENTS

Figure 1:
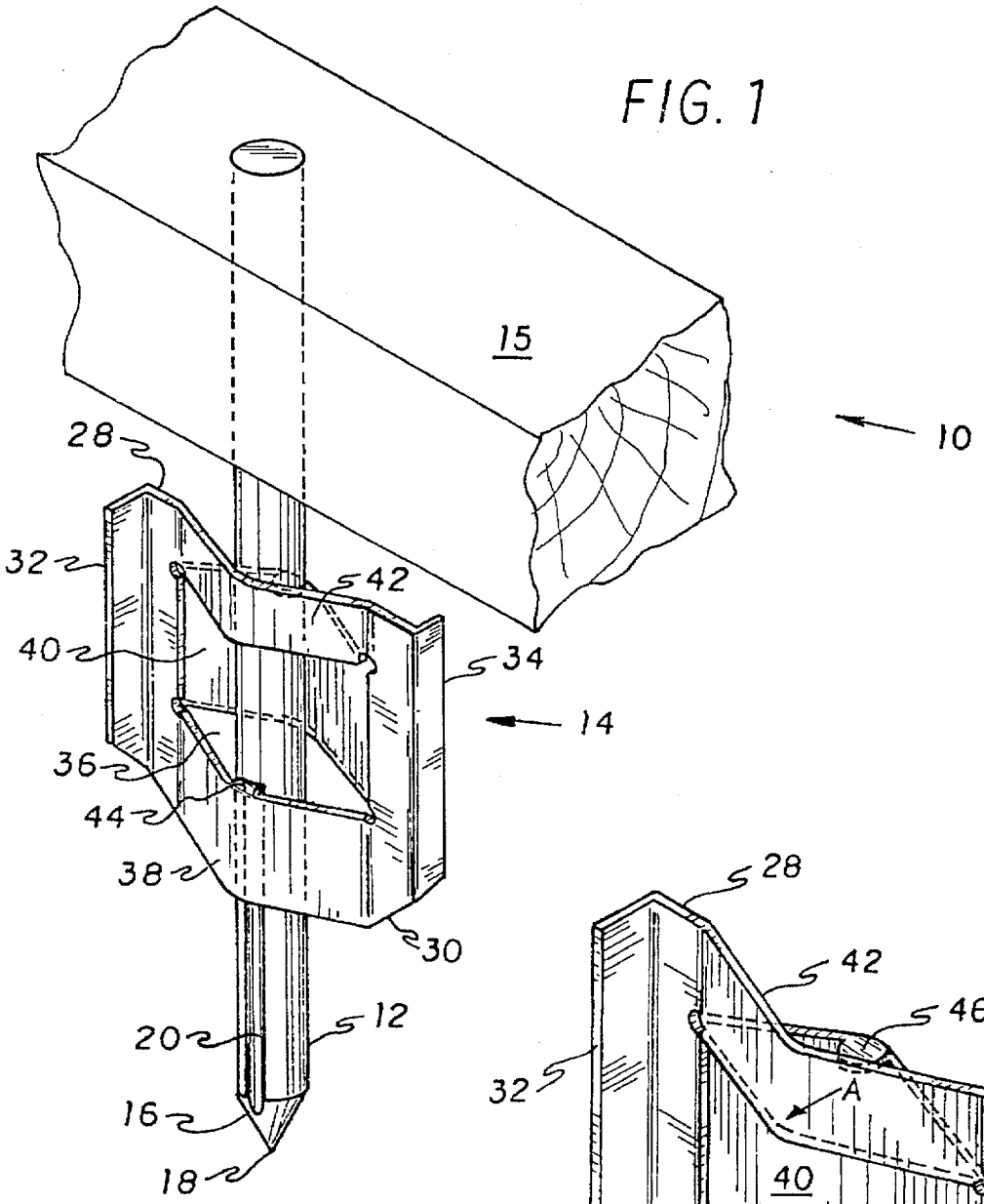
FIG. 1 is an environmental view of the invention showing the anchoring post attached to the anchor plate and driven into the ground to support a landscaping timber.
Figure 2:
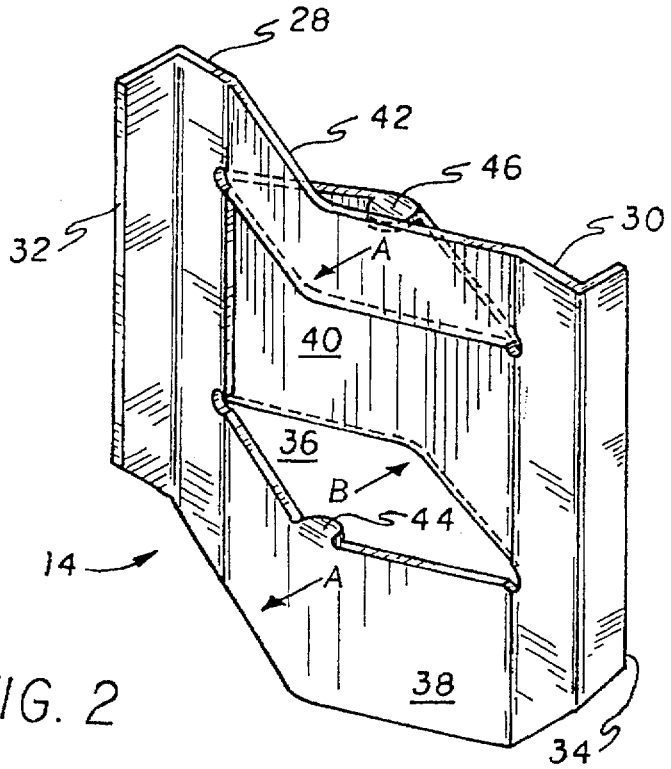
FIG. 2 is a perspective view of the anchor plate.

With reference to the drawings and initially to FIGS. 1–3, there is shown a ground anchoring system indicated generally by the numeral 10. The ground anchoring system 10 consists generally of an anchoring post 12 and an anchor plate 14. A shown in FIG. 1, the ground anchoring system 10 is being used to support a landscaping timber 15.

The anchoring post 12 includes a tapered front end 16 which terminates in a penetrating tip 18. A first channel 20 originates from the front end 16 of the anchoring post 12 and extends a predetermined distance. The first channel 20 terminates at a first stop 24. The first stop 24 is defined by a notch having a depth greater than the first channel 20 within the anchoring post 12. A second channel 22 (not shown) is contained on the opposite side of said anchoring post 12. The second channel 22 originates from a preset distance which is further away from the front end 16 of the anchoring post 12 than the first stop 24. The second channel 22 extends in a direction away from the front end 16 for a predetermined distance. The second channel 22 terminates in a second stop 26. The second stop 26 is also defined by a notch having a depth greater than the second channel 22 within the anchoring post 12.

With particular reference to FIG. 2, a preferred embodiment of the anchor plate 14 of the anchoring system 10 is shown. The anchor plate 14 includes a first and second lateral extension 28, 30. Both the first and second lateral extensions 28, 30 lie on the same plane. A first flange 32 is integrally connected to the end of the first lateral extension 28. A second flange 34 is integrally connected to the end of the second lateral extension 30. As illustrated, the first and second flanges 32, 34 extend along a plane perpendicular to the first and second lateral extensions 28, 30.

A first portion 38 is defined in part of the space between the first and second lateral extensions 28, 30 of the anchor plate 14. The first portion 38 projects in first direction A which is perpendicular to plane of the first and second lateral extensions 28, 30. A second portion 40 is defined in part of the space between the first and second lateral extensions 28, 30. The second portion 40 projects in a second direction B which is opposite the first direction A and perpendicular to the plane of the first and second lateral extensions 28,30. A third portion 42 is defined in part of the space between the first and second lateral extensions 28, 30. The third portion 42 projects in the first direction A.

The first and second portions 38, 40 define a first diamond shaped aperture 36. Similarly, a second diamond shaped aperture 36 is defined by the second and third portions 40, 42. The first and second apertures 36 are of appropriate size for receiving the anchoring post 12.

The first portion 38 includes a first tab 44 originating therefrom and extending in the direction of the second direction B. The second portion 40 includes a second tab 46 originating therefrom and extending in the first direction A. The first and second tabs 44, 46 are appropriately sized so that they may ride in the first and second channels 20, 22 and fittingly engage the first and second stops 24, 26 in order to restrict the motion of the anchoring post 12.

Turning now to FIGS. 4 and 5, there is shown an alternative embodiment for the anchoring post 12. This particular embodiment of the anchoring post 12 also contains a tapered front end 16 which terminates in a penetrating tip 18. A first channel 20 originates from the front end 16 of the anchoring post 12 and extends a predetermined distance. The first channel 20 terminates at a first stop 48. The first stop 48 is defined by a transverse channel which is integral with the first channel 20, and sized to receive the first tab 44. A second channel 22 is contained on the opposite side of said anchoring post 12. The second channel 22 originates from a preset distance which is further away from the front end 16 of the anchoring post 12 than the first stop 48. The second channel 22 extends in a direction away from the front end 16 for a predetermined distance. The second channel 22 terminates in a second stop (not shown). The second stop is also defined by a transverse channel which is integral with the second channel 22, and sized to receive the second tab 46.

In this particular embodiment, the anchoring post 12 is secured to the anchor plate 14 by fitting the anchoring post 12 through the first and second apertures 36 and allowing the first and second tabs 44, 46 to ride in the first and second channels for a predetermined distance. Next, the anchoring post 12 is rotated a preset distance so that the first and second tabs 44, 46 engage the first 48 and second stops. Once engaged, the anchoring post 12 is effectively secured to the anchor plate 14.

Figure 6:
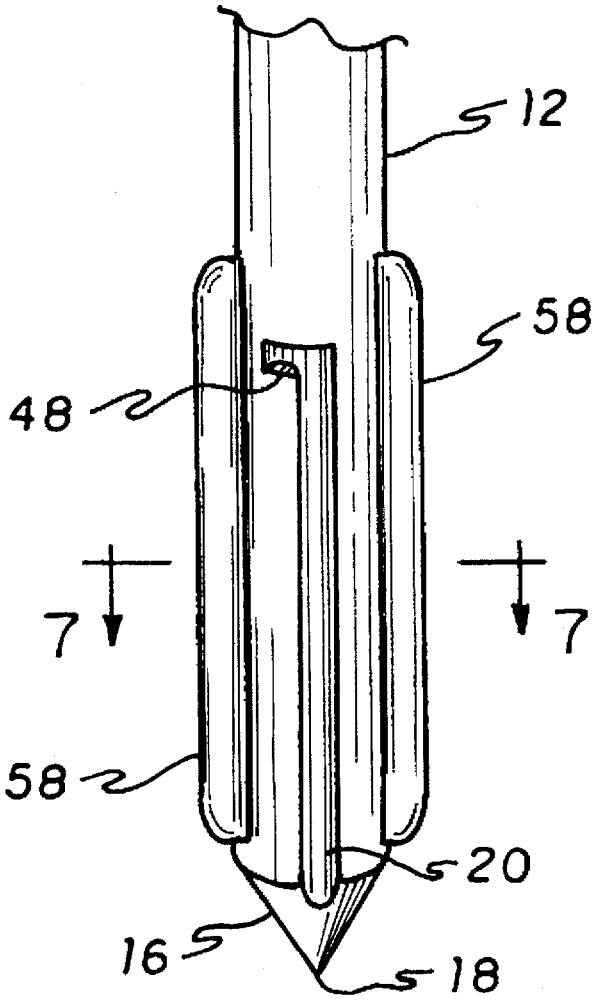
FIG. 6 is a side elevational view of an alternative embodiment of the anchoring post.
Figure 7:
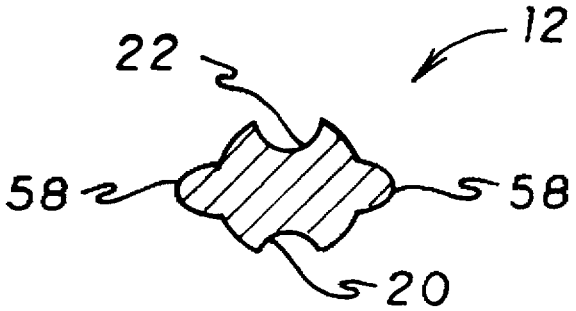
FIG. 7 is a cross-sectional view of the same embodiment taken along line 7—7 of FIG. 6.

FIGS. 6 and 7 illustrate another embodiment of the anchoring post 12. The anchoring post 12 contains a tapered front end 16 which terminates in a penetrating tip 18. A first channel 20 originates from the front end 16 of the anchoring post 12 and extends a predetermined distance. The first channel 20 terminates in a first stop 48. The first stop 48 is defined by a transverse channel which is integral with the first channel 20, and sized to receive the first tab 44. A second channel 22 is contained on the opposite side of said anchoring post 12. The second channel 22 originates from a preset distance which is further away from the front end 16 of the anchoring post 12 than the first stop 48. The second channel 22 extends in a direction away from the front end 16 for a predetermined distance. The second channel 22 terminates in a second stop (not shown). The second stop is also defined by a transverse channel which is integral with the second channel 22, and sized to receive the second tab 46. In this particular embodiment, the anchoring post 12 contains a plurality of flashes 58 on its surface. The flashes 58 are a result of the manufacturing process for the anchoring post 12. In typical applications, a machining step would be used to remove the flashes 58 and smooth the surface of the anchoring post 12. By omitting this manufacturing step, the flashes 58 can serve to provide additional lateral support to the anchoring post 12. This can be particularly useful in situations where the anchoring post 12 is not used in conjunction with an anchor plate 14.

It will be appreciated that there are various other embodiments of the invention which can provide an equivalent function. For example, the anchoring post may have varying cross-sectional shapes, such as circular, oval, rectangular, etc.. Likewise, the anchor plate may be designed alternatively in order to cooperate with the anchoring post. The anchor plate may also contain a more than two flanges. For example, each lateral extension may contain a plurality of flanges, each of which are offset by different angles.

It is to be understood that the present invention is not limited to the embodiments described above, but encompasses any and all embodiments within the scope of the following claims.

I claim:

1. A ground anchoring system comprising:

an anchoring post having:

a tapered front end, a first channel extending along said anchoring post from said tapered front end and extending a predetermined distance, a first stop defined by a notch at the terminal end of said first channel, said notch having a greater depth than said first channel within said anchoring post, a second channel extending a predetermined distance along said anchoring post from a preset location further away from said tapered front end than said first stop and at a location opposite of said first channel with respect to said anchoring post, and a second stop defined by a notch at the terminal end of said second channel, said notch having a greater depth than said second channel within said anchoring post; and an anchor plate having:

a first and second lateral extension, a first portion projecting in a first direction perpendicular to the plane of said plate, said first portion having one end integral with said first lateral extension and the other end integral with said second lateral extension, a second portion projecting in a second direction perpendicular to the plane of said plate, said second direction being opposite to said first direction, and said second portion having one end integral with said first lateral extension and the other end integral with said second lateral extension, a third portion projecting in said first direction, said third portion having one end integral with said first lateral extension and the other end integral with said second lateral extension, a first tab originating from said first portion and extending in said second direction, and said first tab being capable of fitting into said first channel and engaging said first stop, and a second tab originating from said second portion and extending in said first direction, and said second tab being capable of fitting into said second channel and engaging said second stop;

whereby said first, second, and third portions form two generally diamond shaped apertures in registry with one another, and said diamond shaped apertures being sized to receive said anchoring post.

2. A ground anchoring system as recited in claim 1, wherein said anchoring post is cylindrical.

3. A ground anchoring system as recited in claim 2, wherein each said first and second stops further includes a transverse channel integral with said first and second channels, and said first and second stops being capable of preventing relative movement between said anchoring post and said anchor plate.

4. A ground anchoring system as recited in claim 2, further comprising a plurality of flashes along the surface of said anchoring post, said flashes being capable of providing greater lateral support.

5. A ground anchoring system as recited in claim 2, wherein said anchor plate further includes at least one flange integrally connected to each of said lateral extensions.

6. A ground anchoring system as recited in claim 5 wherein each of said flanges extends along a plane perpendicular to said lateral extensions.

* * * * *